US007082630B2

(12) United States Patent
Castonguay et al.

(10) Patent No.: US 7,082,630 B2
(45) Date of Patent: Aug. 1, 2006

(54) SIDERAIL SUPPORT MECHANISM WITH OBLONG PIVOT SLOT

(75) Inventors: Pascal Castonguay, Levis (CA); Marco Morin, Levis (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/978,743

(22) Filed: Nov. 1, 2004

(65) Prior Publication Data

US 2006/0090259 A1 May 4, 2006

(51) Int. Cl.
*A47C 21/08* (2006.01)

(52) U.S. Cl. ..... 5/430; 5/428

(58) Field of Classification Search ..... 5/430, 5/428, 425, 427, 662, 429
See application file for complete search history.

(56) References Cited

U.S. PATENT DOCUMENTS 6,751,815 B1 6/2004 Heimbrock et al.
6,938,289 B1 * 9/2005 Morin ..... 5/425

* cited by examiner

*Primary Examiner*—Alexander Grosz
(74) *Attorney, Agent, or Firm*—Flynn, Thiel, Boutell & Tanis, P.C.

(57) ABSTRACT

A siderail support mechanism comprises a bottom cross-member having a first lower pivot and a second lower pivot, a first support arm and a second support arm. The first support arm includes a first upper pivot shaft and a first lower pivot shaft, the first upper pivot shaft being configured to pivotally attach to the siderail at a first upper pivot and the first lower pivot shaft configured to pivotally attach to the first lower pivot of the bottom cross-member. The first upper pivot includes an oblong slot. The second support arm includes a second upper pivot shaft having a locking cog for locking the siderail in a deployed position. A release handle is centrally positioned on the siderail to enable one-handed operation in disengaging the locking mechanism and lowering the siderail to a stowed position.

22 Claims, 11 Drawing Sheets

SIDERAIL SUPPORT MECHANISM WITH OBLONG PIVOT SLOT

FIELD OF THE INVENTION

The invention relates to support mechanisms for hospital bed siderails. In one of its aspects, the invention relates to a four-bar link for a support mechanism with an anti-binding feature. In another of its aspects, the invention relates to a siderail support mechanism with an under-bed retracting feature.

DESCRIPTION OF THE RELATED ART

Four-bar link mechanisms require careful dimensional control to avoid binding as the mechanism traverses through a full range of motion. As the four-bar link is required to pass a "zero" point wherein the arms are required to change relative position, this is especially important.

Hospital bed siderails are used in an upright position, but when in a stowed position that is in the same plane as the upright position, the siderail can interfere with access by a health care provider. Known hospital bed siderails further require a two-handed operation to raise to a deployed position or to lower to a stowed position.

It would be advantageous to provide a siderail locking mechanism that securely locks the siderail in the upright deployed position, but that is also capable of being unlocked and rotated to a stowed position using a one-handed operation and without binding, and that is further capable of being moved completely out of the way when in the stowed position, such as in a retracted position underneath the bed.

SUMMARY OF THE INVENTION

A siderail support mechanism comprises a bottom cross-member having a first lower pivot and a second lower pivot, a first support arm and a second support arm. The first support arm includes a first upper pivot shaft and a first lower pivot shaft, the first upper pivot shaft being configured to pivotally attach to the siderail at a first upper pivot and the first lower pivot shaft configured to pivotally attach to the first lower pivot of the bottom cross-member. The first upper pivot includes an oblong slot. The second support arm includes a second upper pivot shaft and a second lower pivot shaft, the second upper pivot shaft being configured to pivotally attach to the siderail at a second upper pivot and the second lower pivot shaft configured to pivotally attach to the second lower pivot of the bottom cross-member.

In a further embodiment, the siderail support mechanism includes a locking arm pivotally mounted to the siderail at a first end and having a locking tooth at a second end, the locking arm being biased downwardly by a spring for the locking tooth to engage a locking cog mounted on the second upper pivot shaft when the siderail is in an upright, deployed position.

In a further embodiment, the siderail support mechanism includes a locking mechanism and a lock release mechanism including a handle positioned at the center of gravity of the siderail. The handle is configured for one-handed operation of the lock release and lowering of the siderail to a stowed position.

In a further embodiment, the bottom cross-member includes a retraction mechanism. The retraction mechanism includes a pair of mounting brackets for attachment to a bed frame. A pair of retracting arms are pivotally attached between the mounting brackets and the bottom cross-member to form a four-bar link.

DETAILED DESCRIPTION OF THE PREFERRED EMBODIMENT

Figure 1:
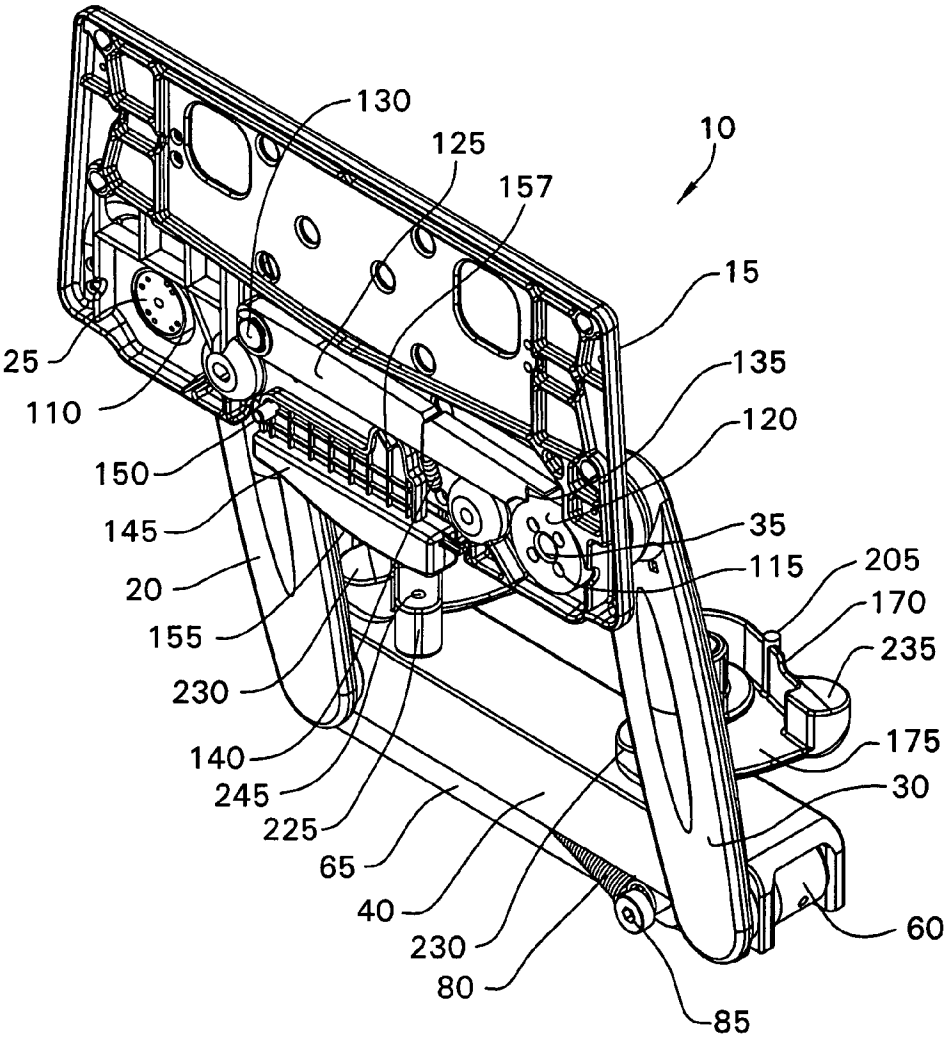
FIG. 1 is a perspective view of a siderail with siderail support mechanism having an oblong pivot slot according to the invention.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "head" and "foot" will refer to the respective ends of a hospital bed, and the word longitudinal refers to an orientation parallel to a line running from the head to the foot of the bed. Such terminology will include derivatives and words of similar import.

Referring to FIGS. 1–5, the siderail with siderail support mechanism 10 is illustrated. The siderail with siderail support mechanism 10 comprises a siderail 15 pivotally mounted to a first support arm 20 at a first upper pivot shaft 25 and a second support arm 30 at a second upper pivot shaft 35. The first support arm 20 is pivotally mounted to a bottom cross-member 40 at a first lower pivot shaft 45. The second support arm 30 is pivotally mounted to the bottom cross-member 40 at a second lower pivot shaft 50. A first toggle 55 is mounted on the first lower pivot shaft 45 so as to rotate about the first lower pivot shaft 45 with the first support arm 20. A second toggle 60 is similarly mounted on the second lower pivot shaft 50 so as to rotate with the second support arm 30 on the second lower pivot shaft 50. A synchronizing link 65 is pivotally connected to the first toggle 55 at a pivot pin 70 and to the second toggle 60 at a pivot pin 75. The toggles 55, 60 are mounted to the lower pivot shafts 45, 50 at slightly different angle so that the support arms 20, 30 are nonparallel.

The synchronizing link 65 is connected to the bottom cross-member 40 by a load spring 80 connected to the synchronizing link 65 at a fastener 85 and to the bottom cross-member 40 at spring anchor 90. The synchronizing link 65 is further connected to the bottom cross-member 40 by a gas cylinder 95 secured to the synchronizing link 65 at a fastener 100 and to the bottom cross-member 40 at a gas cylinder anchor 105.

The siderail 15 includes an oblong slot or aperture 110 for receiving the first upper pivot shaft 25. The oblong aperture 110 has a minor vertical axis with a diameter substantially equivalent to the diameter of the first upper pivot shaft 25 and a major horizontal axis having a diameter greater than the diameter of the minor axis and defined by a left extent 112 and a right extent 114. The major axis of the oblong aperture 110 is substantially parallel to a line drawn between the centers of the first and second upper pivot shafts 25, 35. The siderail 15 further includes a regular aperture (not shown) for closely receiving the second upper pivot shaft 35. A wheel cog 115 is mounted on the second upper pivot shaft 35 and includes a radially projecting locking cog 120. The wheel cog 115 is affixed to the second upper pivot shaft 35 in a manner to be rotatably fixed with respect to the second support arm 30.

The siderail 15 further includes a pivotally connected locking arm 125. The locking arm 125 pivots on a pivot pin 130 at a first end thereof and includes a locking tooth 135 at a second end thereof. The locking arm 125 is biased downwardly by a spring 140. The siderail 15 further includes a lock release handle 145 pivotally connected to the siderail 15 by a pivot pin 150. The lock release handle 145 includes a contact pad 155 adapted for grasping by an operator and a locking arm engaging projection 157 configured to engage the underside of the locking arm 125.

The lock release handle 145 and contact pad 155 are configured so that as the operator grasps the contact pad 155, the operator is applying the force in a centered position between the upper pivot shafts 25, 35 and coinciding with the center of gravity of the siderail 15. The operator is thus able to grasp and support the siderail 15 in a balanced fashion, disengage the locking arm 125, and lower the siderail 15, in a one-handed operation.

Figure 2:
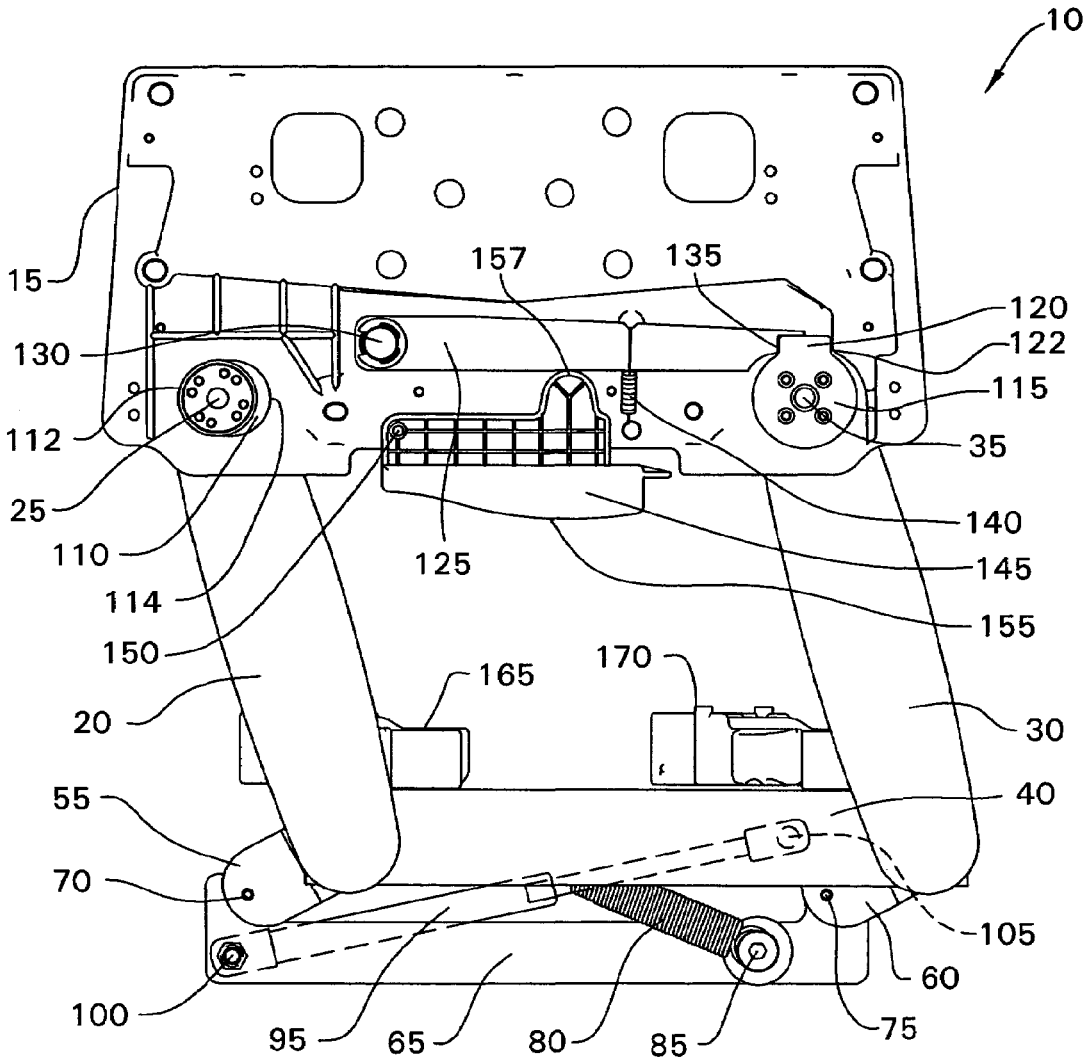
FIG. 2 is a front view of the siderail with siderail support mechanism of FIG. 1.

Referring specifically to FIGS. 1–2, the siderail 15 is locked in its uppermost position, wherein the locking cog 120 of the wheel cog 115 is engaged by the locking tooth 135 of the locking arm 125. In this illustrated uppermost position, the support arms 20, 30 are not fully upright, but are positioned at an angle from the vertical. In the alternative, the locking tooth 135 and the locking cog 120 can be configured to secure the support arms 20, 30 in a vertical orientation.

The siderail 15 includes an integrally molded stop 122 adjacent to the locking cog 120 of the wheel cog 115 to prevent further clockwise rotation of the wheel cog 115 from the position shown in FIG. 2.

Figure 3:
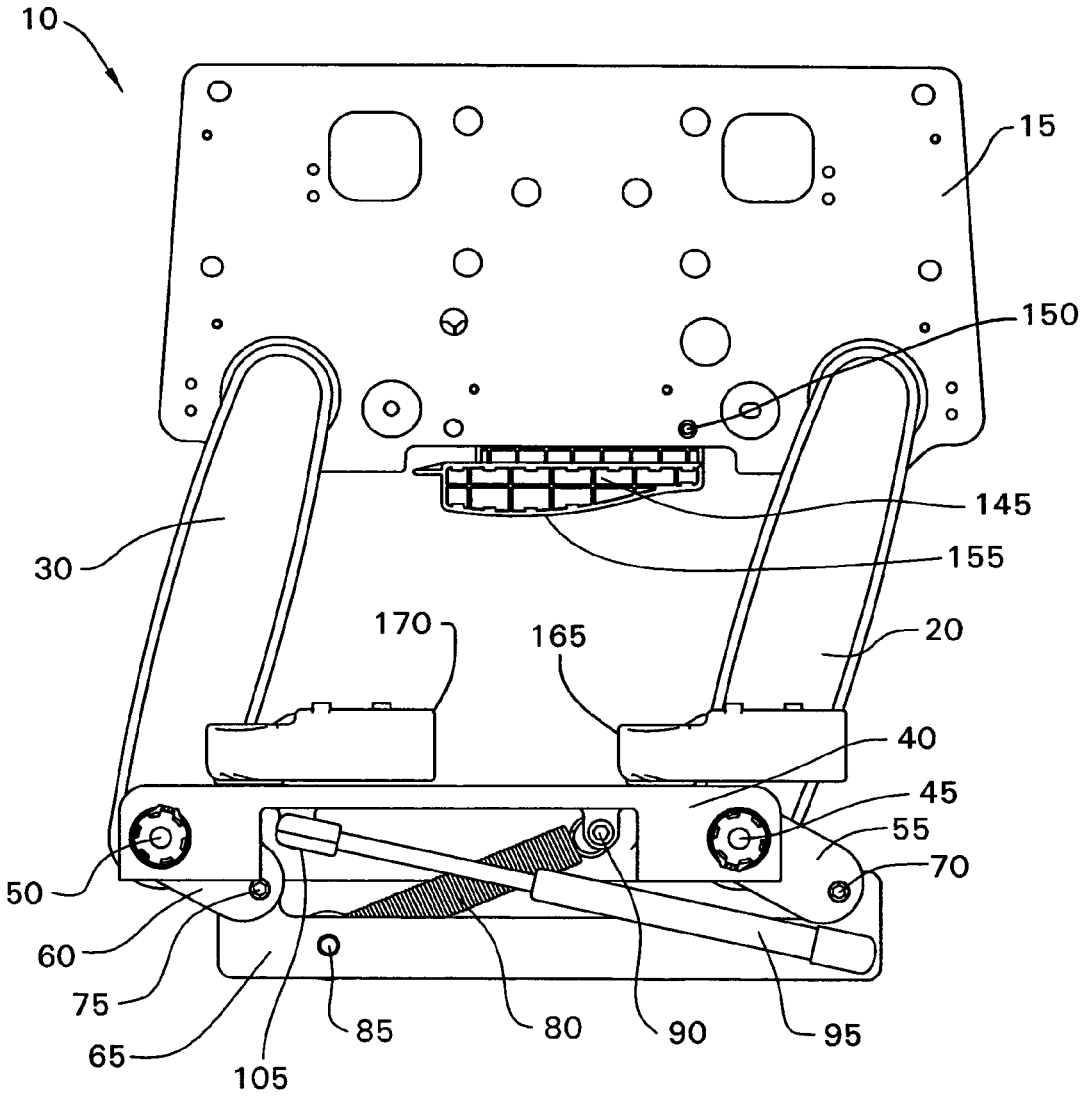
FIG. 3 is a rear view of the siderail with siderail support mechanism of FIGS. 1–2.
Figure 4:
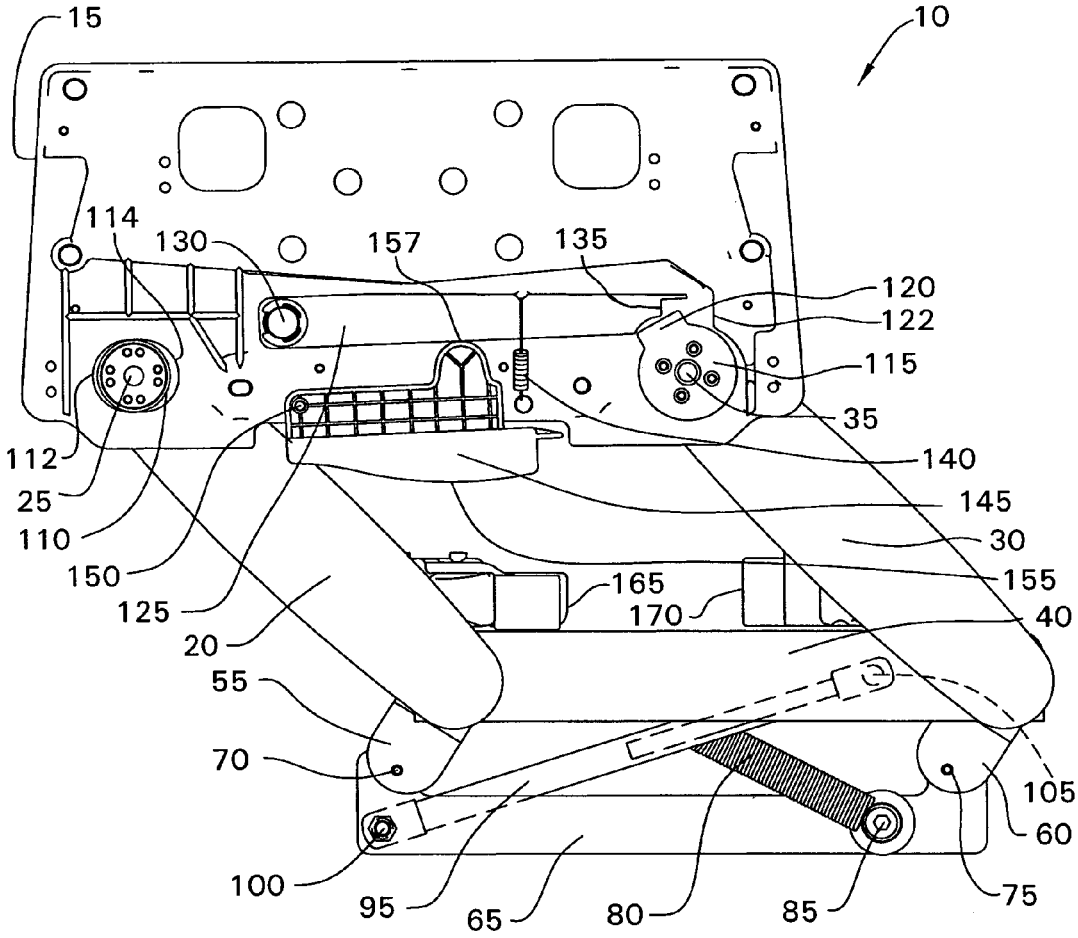
FIG. 4 is a front view of the siderail with siderail support mechanism of FIGS. 1–3 in an unlocked position.

The siderail 15 is prevented from rotating to a lower position due to the action of the locking tooth 135 of the locking arm 125 with the locking cog 120 of the wheel cog 115. As shown in FIG. 3, as an operator draws upwardly on the lock release handle 145 by contacting the pad 155, the lock release handle 145 pivots about the pin 150 and the projection 157 engages the locking arm 125. The locking arm 125 is raised against the bias of the spring 140 so that the locking tooth 135 disengages the locking cog 120 of the wheel cog 115. This frees the siderail mechanism 10 to rotate counterclockwise to a lower position as shown in FIG. 4.

As the support arms 20, 30 rotate counterclockwise about the first and second lower pivot shafts 45, 50, the first upper pivot shaft 25 shifts laterally within the oblong slot 110.

Figure 5:
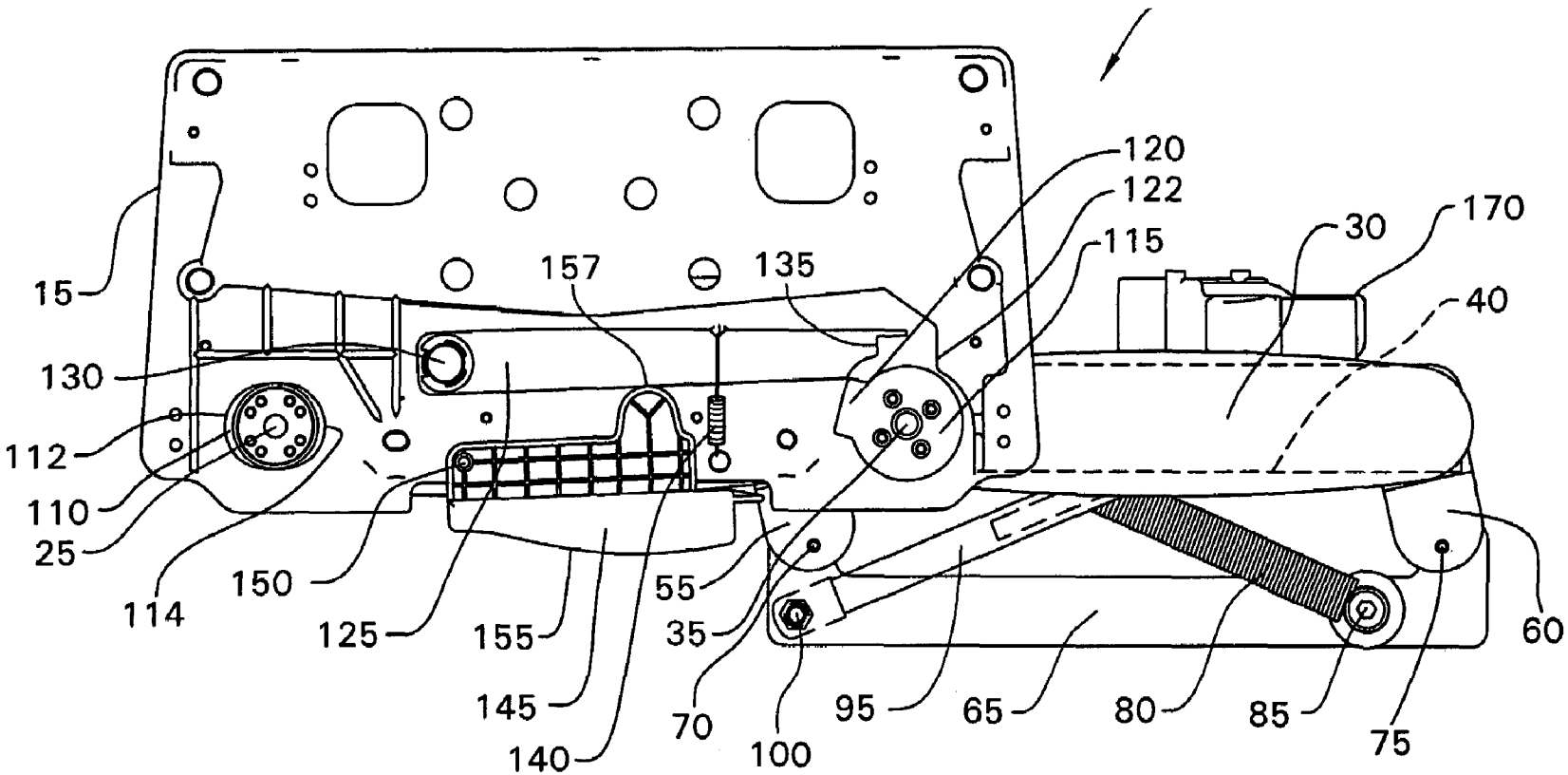
FIG. 5 is a front view of the siderail with siderail support mechanism of FIGS. 1–4 in a partially stowed position.
Figure 6:
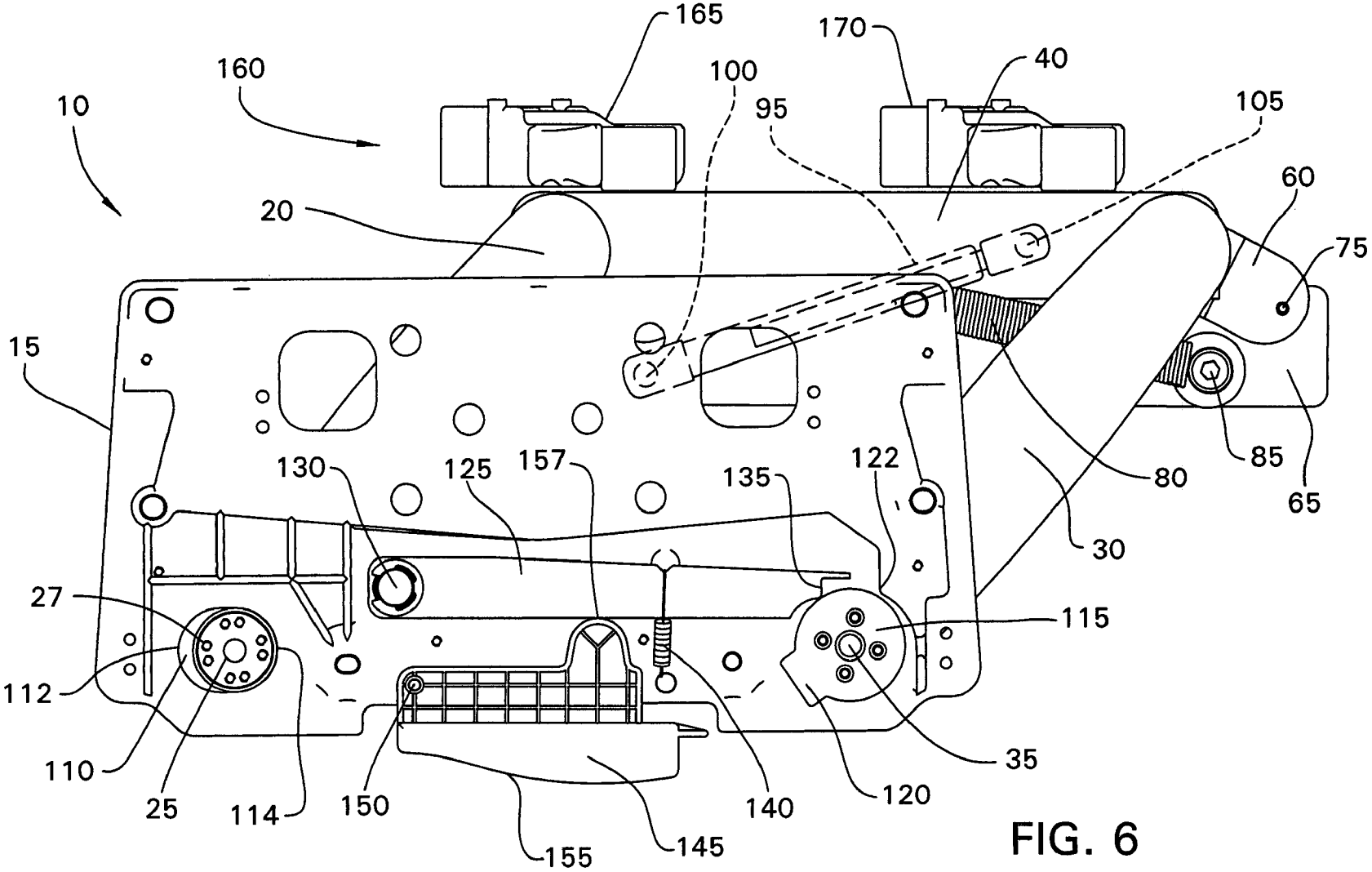
FIG. 6 is a front view of the siderail with siderail support mechanism of FIGS. 1–5 with the siderail in the stowed position.

As the siderail mechanism 10 is further rotated counterclockwise to the zero point shown in FIGS. 5–6 the support arms 20, 30 are nonparallel to each other to ease the passage of the siderail mechanism 10 through the zero point. The oblong slot 110 allows this nonparallel arm geometry without binding.

As the siderail 15 is lowered, the load spring 80 reduces the apparent load or weight of the siderail 15 to the operator. The gas cylinder 95 acts as a damper to soften the drop of the siderail 15. In concert, the load spring 80 and gas cylinder 95 can lower the siderail 15 in a controlled fashion upon release by the operator.

Referring now to FIG. 6, the siderail 15 is shown in its lowermost position, wherein the first toggle 55 contacts a portion of the bottom cross-member 40 to prevent further rotation of the first arm 20 about the first lower pivot shaft 45. In this lowermost position, the first upper pivot shaft 25 has shifted from the left extent 112 of the oblong slot 110 in FIG. 2 to the right extent 114 of the oblong slot 110.

Figure 7:
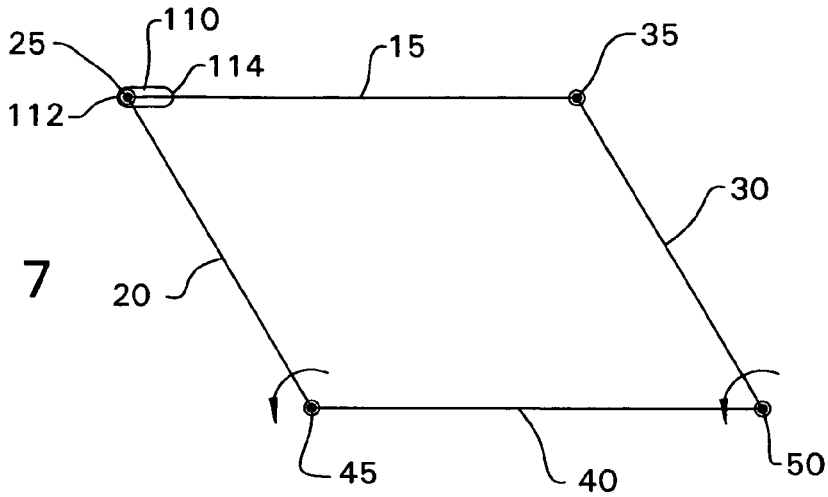
FIGS. 7–10 are schematic representations of the four bar link of the siderail with siderail support mechanism of FIGS. 2 and 4–6.
Figure 8:
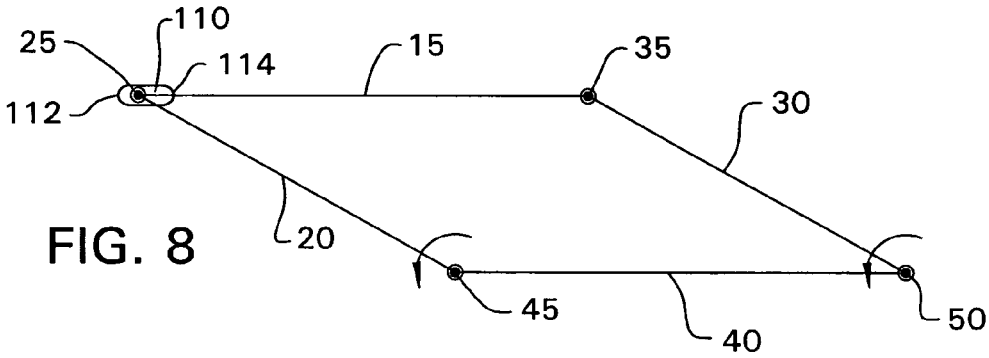
Figure 9:
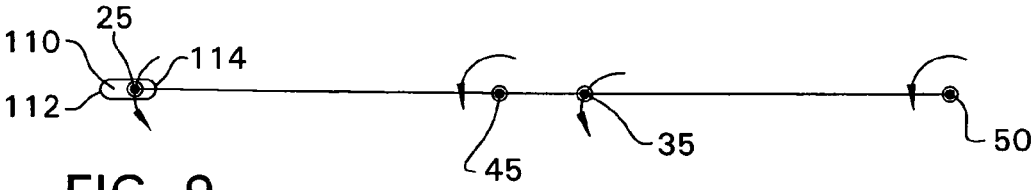
Figure 10:
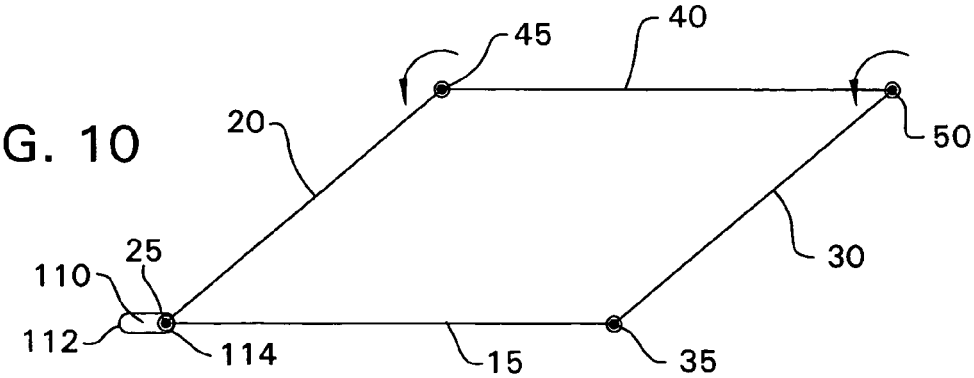

A sequence of movement of the first upper pivot shaft 25 within the oblong slot 110 is illustrated in FIGS. 7–10. In FIG. 7 the first upper pivot shaft 25 is at the left extent 112 of the oblong slot 110. As the siderail mechanism 10 is moved from the uppermost position of FIG. 7 (corresponding to FIG. 2) to the lowermost position of FIG. 10 (corresponding to FIG. 6), the first upper pivot shaft 25 shifts from the left extent 112 toward the right extent 114 of the oblong slot 110. The distance between the first upper pivot shaft 25 and the second upper pivot shaft 35 thereby decreases as the siderail mechanism 10 is moved from its uppermost position to its lowermost position. This movement further acts to ease any binding that might occur in the four bar link system of the conventional siderail support mechanism 10.

In order to raise the siderail 15, an operator can grasp the siderail 15 at any convenient location. As shown in FIG. 6, the locking arm 125 is disengaged from the wheel cog 115, the support arm 20, 30 thereby being free to rotate. Any off-center force exerted by the operator does not cause binding in the four bar linkage due to the non-parallel configuration of the support arms 20, 30 and the oblong slot 110.

Figure 11:
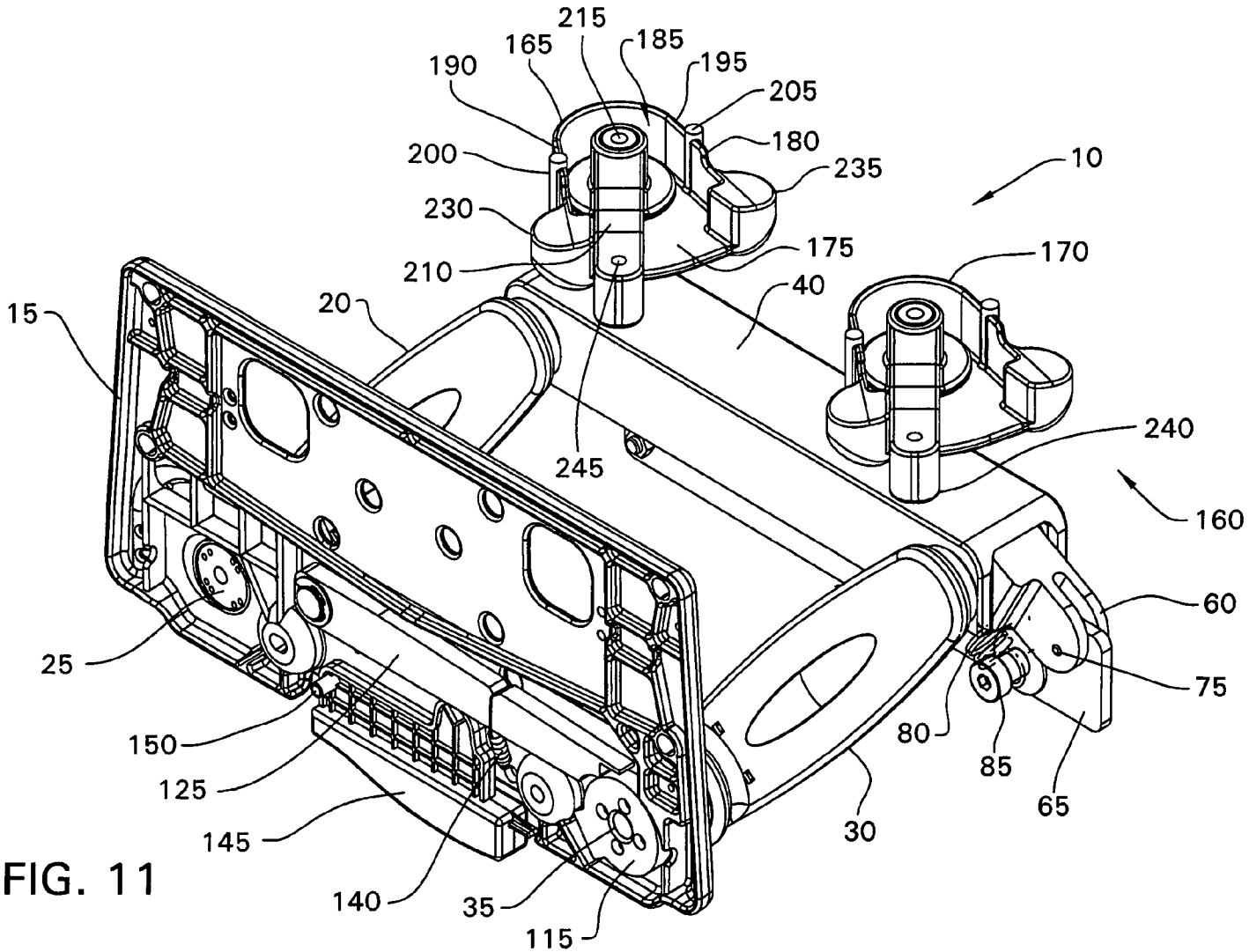
FIG. 11 is a perspective view of the siderail with siderail support mechanism according to FIG. 6.
Figure 12:
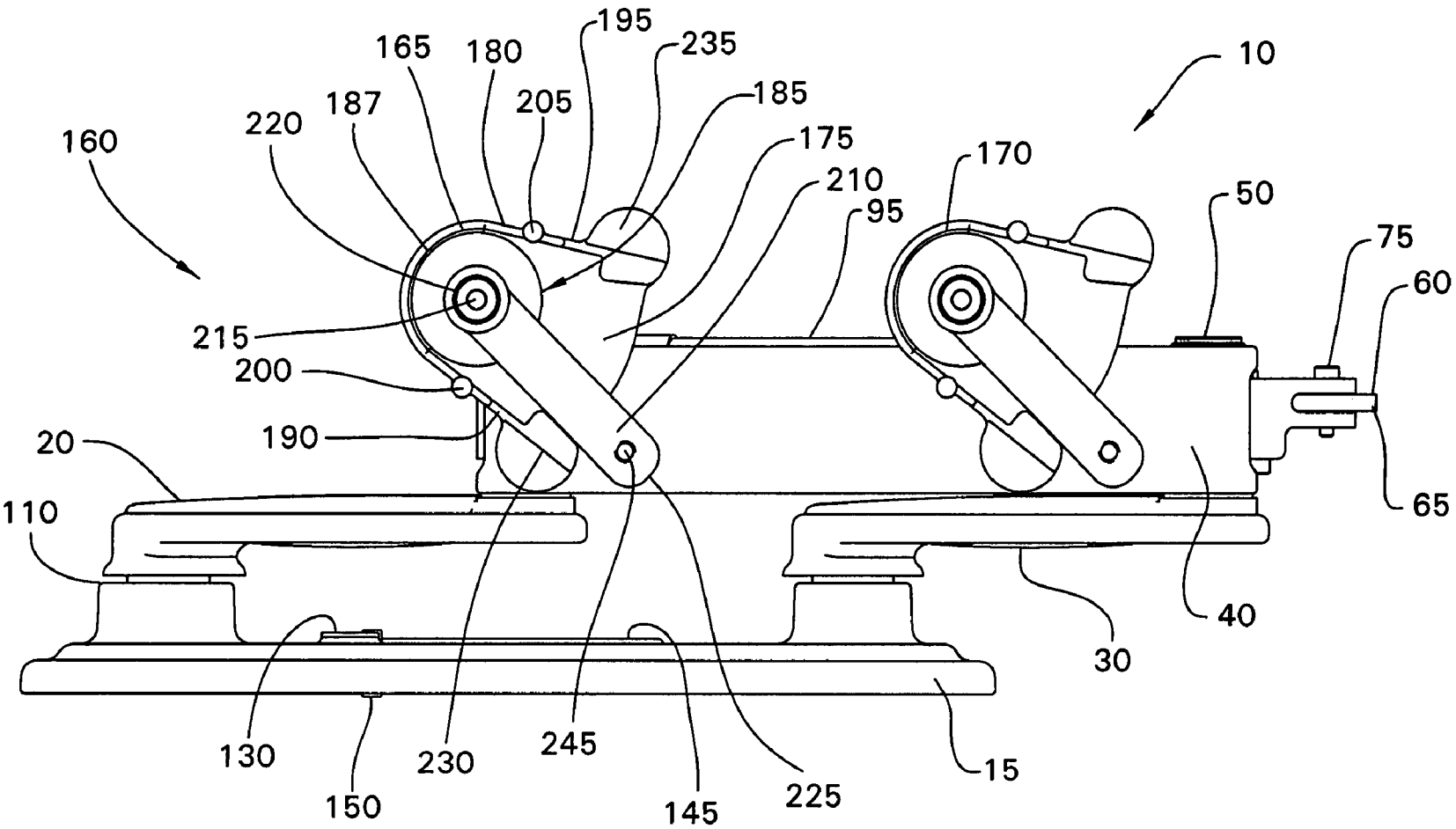
FIG. 12 is a plan view of the siderail with siderail support mechanism according to FIGS. 6 and 11.
Figure 13:
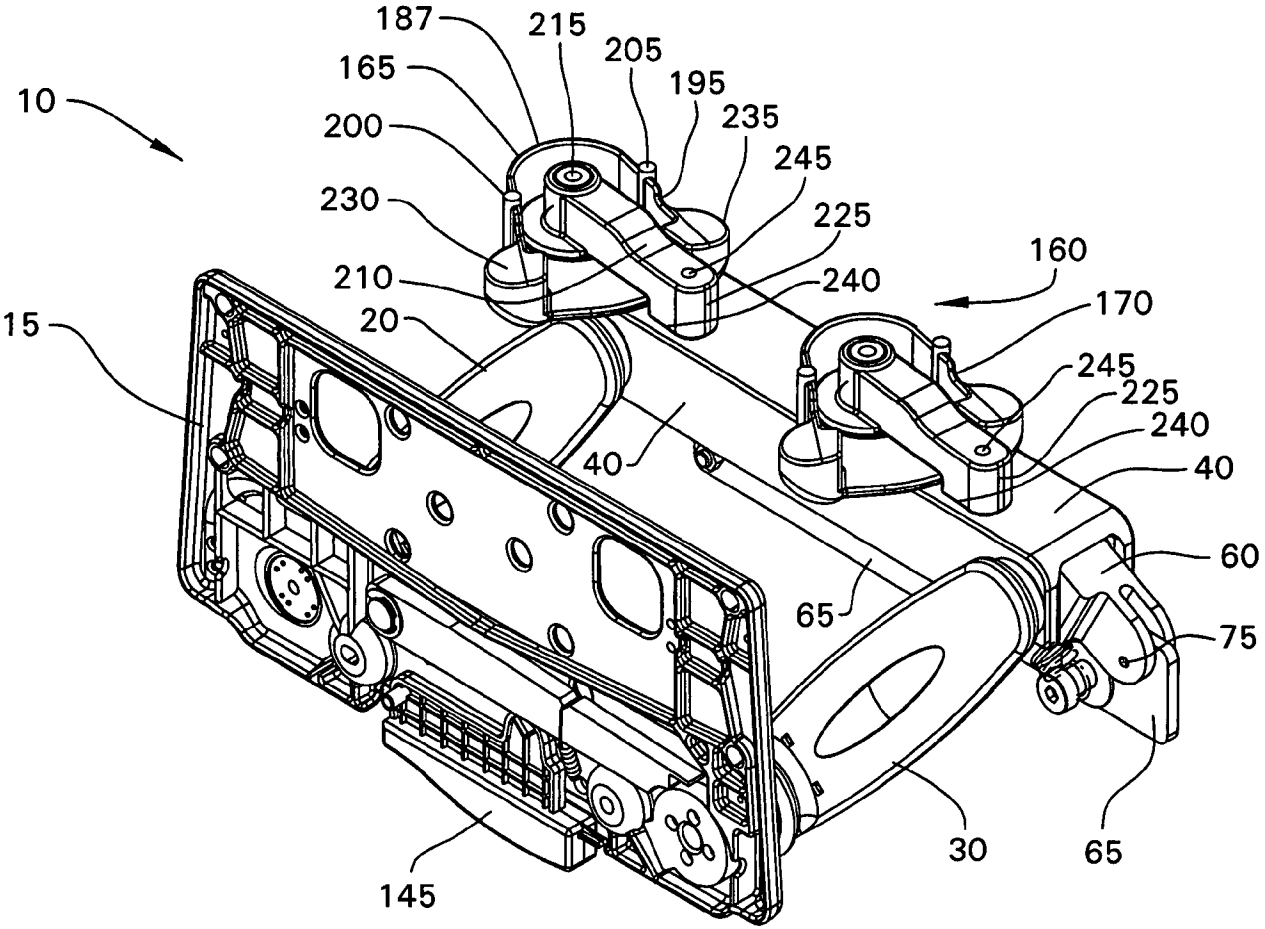
FIG. 13 is a perspective view of the siderail with siderail support mechanism of FIGS. 1 to 12 in the stowed and retracted position.
Figure 14:
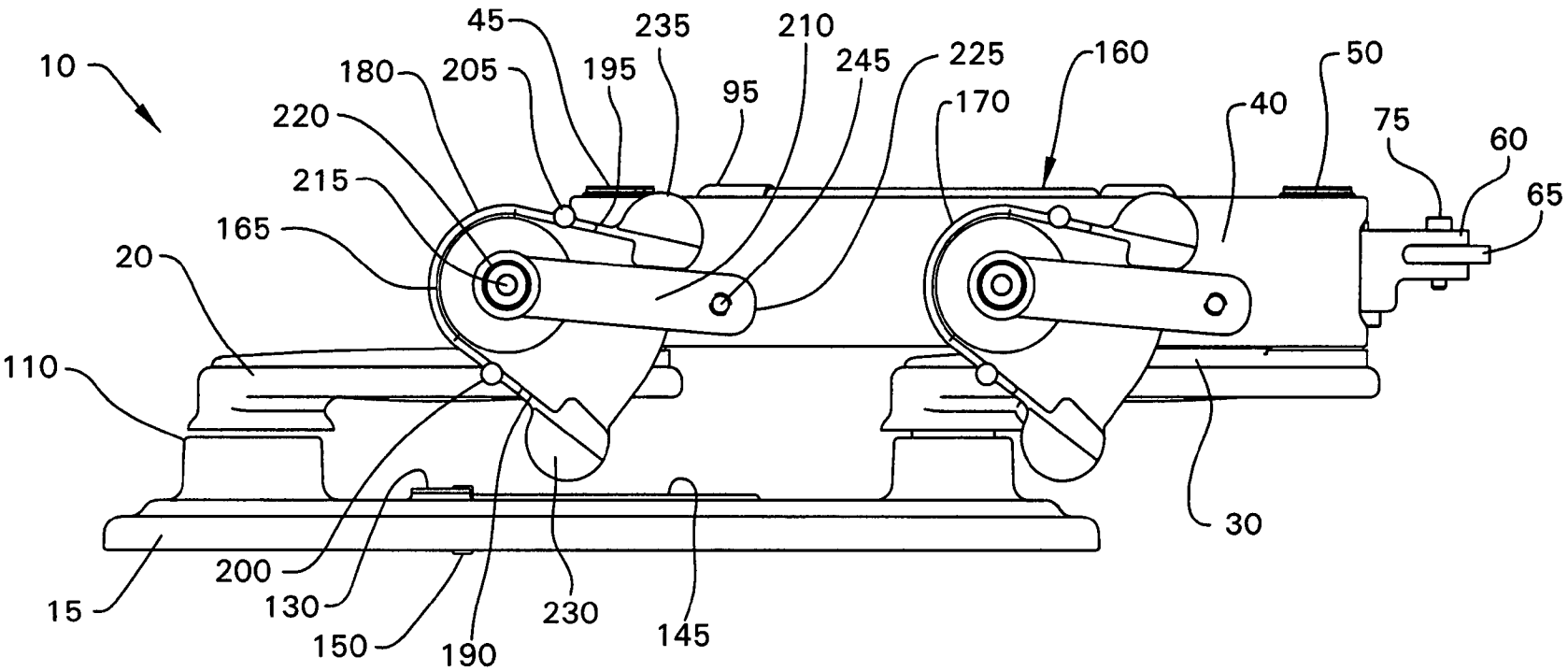
FIG. 14 is a plan view of the siderail with siderail support mechanism according to FIG. 13.

Referring now to FIGS. 11–13, a siderail retraction mechanism 160 of the siderail support mechanism 10 is illustrated. The siderail retraction mechanism 160 includes first and second mounting brackets 165, 170 for attaching the siderail support mechanism 10 to a bed frame (not shown). The first and second mounting brackets 165, 170 being identical in construction, like reference numbers will be used to identify like elements on the first and second mounting brackets 165, 170. The following description will be directed to the first mounting bracket 165, but it applies equally to the second mounting bracket 170.

The first mounting bracket 165 includes a horizontally oriented base plate 175 and an upstanding edge wall 180. In the plan view of FIG. 12, the wall 180 surrounds substantially three sides of the base plate 175 to form an open-ended U-shaped cavity 185. The wall 180 includes a bight portion 187 and a pair of legs 190, 195, with the legs 190, 195 of the "U" being slightly opened up and non-parallel. Each leg 190, 195 includes an integrally formed vertical sleeve 200, 205 for receiving a fastener (not shown) to attach the first mounting bracket 165 to the bed frame.

A retracting arm 210 is pivotally mounted to the base plate 175 within the cavity 185 by a pivot pin 215 passing through a base end 220 of the retracting arm 210. The retracting arm 210 is pivotally mounted centered within the cavity 185 proximate the bight portion 187 of the wall 180, and extends between the legs 190, 195 to a free end 225 extending beyond the base plate 175. The retracting arm 210 is free to pivot through a range defined by a pair of stops 230, 235 formed at the end of each respective leg 190, 195 of the wall 180.

The free end 225 further includes a depending portion 240 (FIG. 13) configured to extend lower than a lower surface of the base plate 175. The depending portion 240 enables the free end 225 of the retracting arm 210 to be pivotally mounted to the bottom cross-member 40 of the siderail support mechanism 10 by a pivot pin 245, with the bottom cross-member 40 positioned underneath the mounting brackets 165, 170. The retracting mechanism 160 forms a four-bar link mechanism between the first and second mounting brackets 165, 170 attached to the bed frame, the retracting arms 210 pivotally attached between the mounting brackets 165, 170 and the bottom cross-member 40.

In the upright, deployed position of FIGS. 1–3, the first support arm 20 is positioned in front of the stop 230 of the leg 190, preventing movement of the bottom cross-member 40 underneath the mounting brackets 165, 170 and preventing rotation of the retracting arms 210. FIGS. 11–12 show the siderail 15 and siderail support mechanism 10 in the lowered but unretracted position. With the siderail support mechanism 10 in the lowered position, the bottom cross-member 40 is capable of being further retracted underneath the mounting brackets 165, 170 by an operator simply pushing the siderail 15 toward the bed. This will cause the retracting arms 210 to pivot about the pivot pins 215, 245 and the bottom cross-member 40 to shift in a parallel fashion underneath the mounting brackets 165, 170.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A siderail support mechanism comprising:

a bottom cross-member having a first lower pivot and a second lower pivot;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the bottom cross-member, wherein one of the first upper pivot and the first lower pivot comprise an oblong slot;

a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the mounting bracket;

a locking arm pivotally mounted to the siderail at a first end, the locking arm having a locking tooth at a second end, and being biased downwardly by a lock spring; and a locking cog mounted on the second upper pivot shaft and configured to engage the locking tooth when the siderail is in an upright, deployed position.

2. The siderail support mechanism of claim 1, further comprising a first toggle mounted on the first lower pivot shaft and a second toggle mounted on the lower pivot shaft and a synchronization link connecting the first and second toggles to coordinate rotation of the first and second lower pivot shafts.

3. The siderail support mechanism of claim 2, wherein the first and second toggles are mounted on the first and second lower pivot shafts to place the first and second supports in a non-parallel configuration.

4. The siderail support mechanism of claim 2, further comprising a load spring operatively connected between the bottom cross-member and the synchronization link.

5. The siderail support mechanism of claim 2, wherein at least one of the first and second toggles contacts the bottom cross-member when the support mechanism reaches a stowed position.

6. The siderail support mechanism of claim 1, further comprising a release lever for shifting the locking arm against the bias of the lock spring and disengaging the locking tooth from the locking cog.

7. The siderail support mechanism of claim 1, wherein the first upper pivot comprises an oblong slot.

8. The siderail support mechanism of claim 7, wherein the first upper pivot shaft shifts in the first upper pivot as the siderail is lowered from an upright, deployed position to a lowered, stowed position.

9. The siderail support mechanism of claim 1, wherein the siderail is formed with a stop that engages the locking cog for defining an upright position in concert with the locking tooth.

10. The siderail support mechanism of claim 1, wherein the bottom cross-member further comprises a retracting mechanism for attaching to a bed frame and configured to shift the siderail support mechanism underneath the bed frame when stowed.

11. The siderail support mechanism of claim 10, wherein the retracting mechanism comprises a pair of mounting brackets for attachment to the bed frame and a pair of retracting arms pivotally mounted between the mounting brackets and the bottom cross-member to form a four-bar link.

12. A siderail support mechanism comprising:

a bottom cross-member having a first lower pivot and a second lower pivot;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the bottom cross-member; and a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the mounting bracket, wherein one of the first upper pivot and the first lower pivot comprises an oblong slot.

13. The siderail support mechanism of claim 12, further comprising a toggle mounted on each of the first and second lower pivot shafts and a synchronization link connecting the toggles to coordinate rotation of the first and second lower pivot shafts.

14. The siderail support mechanism of claim 12, wherein the oblong slot includes a minor axis and a major axis, the major axis defining a line drawn from a center of rotation of the first upper pivot shaft to a center of rotation of the second upper pivot shaft.

15. A siderail support mechanism comprising:

a bottom cross-member having a first lower pivot and a second lower pivot;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the bottom cross-member;

a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the bottom cross-member;

a locking mechanism in the siderail configured to engage one of the first and second support arms to prevent lowering of the siderail; and a release handle having a center of gravity centered between the first and second upper pivot shafts and configured for one-handed unlocking and lowering of the siderail to a stowed position.

16. The siderail support mechanism of claim 15, wherein the locking mechanism comprises:

a locking arm pivotally mounted to the siderail at a first end, the locking arm having a locking tooth at a second end, and being biased downwardly by a lock spring; and a locking cog mounted on the second upper pivot shaft and configured to engage the locking tooth when the siderail is in an upright, deployed position.

17. The siderail support mechanism of claim 16, wherein the release handle further comprises a projection for shifting the locking arm against the bias of the lock spring and disengaging the locking tooth from the locking cog.

18. The siderail support mechanism of claim 15, further comprising a toggle mounted on each of the first and second lower pivot shafts and a synchronization link connecting the toggles to coordinate rotation of the first and second lower pivot shafts.

19. The siderail support mechanism of claim 18, further comprising a load spring operatively connected between the bottom cross-member and the synchronization link.

20. The siderail support mechanism of claim 18, further comprising a gas cylinder operatively connected between the bottom cross-member and the synchronization link, the load spring and gas cylinder being configured to lower the siderail in a controlled fashion.

21. The siderail support mechanism of claim 15, wherein the bottom cross-member further comprises a retracting mechanism for attaching to a bed frame and configured to shift the siderail support mechanism underneath the bed frame when stowed.

22. The siderail support mechanism of claim 21, wherein the retracting mechanism comprises a pair of mounting brackets for attachment to the bed frame and a pair of retracting arms pivotally mounted between the mounting brackets and the bottom cross-member to form a four-bar link.

* * * * *

UNITED STATES PATENT AND TRADEMARK OFFICE

CERTIFICATE OF CORRECTION

PATENT NO. : 7,082,630 B2
APPLICATION NO. : 10/978743
DATED : August 1, 2006
INVENTOR(S) : Pascal Castonguay and Marco Morin It is certified that error appears in the above-identified patent and that said Letters Patent is hereby corrected as shown below:

Claims

Claim 20, column 8, line 19

"load spring and gas cylinder being configured to lower the"

should be

--gas cylinder being configured to lower the--

Signed and Sealed this
Twenty-fourth Day of November, 2015

Michelle K. Lee

Michelle K. Lee
*Director of the United States Patent and Trademark Office*